US010376909B2

(12) United States Patent
Mizushima et al.

(10) Patent No.: US 10,376,909 B2
(45) Date of Patent: Aug. 13, 2019

(54) PUMP TYPE DISPENSER

(71) Applicants: Hiroshi Mizushima, Tokyo (JP); Tsuyoshi Sasaki, Tokyo (JP)

(72) Inventors: Hiroshi Mizushima, Tokyo (JP); Tsuyoshi Sasaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/576,630

(22) PCT Filed: May 20, 2016

(86) PCT No.: PCT/JP2016/065092

§ 371 (c)(1),
(2) Date: Nov. 22, 2017

(87) PCT Pub. No.: WO2016/194665

PCT Pub. Date: Dec. 8, 2016

(65) Prior Publication Data

US 2018/0126399 A1 May 10, 2018

(30) Foreign Application Priority Data

May 29, 2015 (JP) ..... 2015-109501

(51) Int. Cl.
*B05B 11/00* (2006.01)
*F04B 9/14* (2006.01)

(52) U.S. Cl.
CPC ..... *B05B 11/0089* (2013.01); *B05B 11/3001* (2013.01); *F04B 9/14* (2013.01);
(Continued)

(58) Field of Classification Search
CPC .... B05B 1/02; B05B 11/0089; B05B 11/3001
(Continued)

(56) References Cited

U.S. PATENT DOCUMENTS 5,443,569 A * 8/1995 Uehira ..... B05B 7/0031 222/190
7,735,692 B2 * 6/2010 Nelson ..... B05B 11/3087 222/153.13

(Continued)

FOREIGN PATENT DOCUMENTS

CN 1596154 A 3/2005
CN 101184557 A 5/2008

(Continued)

OTHER PUBLICATIONS

Aug. 16, 2016 International Search Report issued in International Patent Application No. PCT/JP2016/065092.

(Continued)

*Primary Examiner* — Vishal Pancholi
(74) *Attorney, Agent, or Firm* — Oliff PLC

(57) ABSTRACT

Disclosed in the present invention is a pump type dispenser which includes a pump held by a mouth portion of a container and configured to suction and pressure-feed a content liquid in the container, and a nozzle head having an internal passage through which the pressure-fed content liquid passes and driving the pump by being repeatedly pushed down and restored. The internal passage includes a vertical passage, a lateral passage, and a protrusion protruding toward an inner side in a joining portion between the vertical passage and the lateral passage, and a dispensing member disposed in the lateral passage includes a recessed portion which engages with the protrusion to prevent separation from the lateral passage.

6 Claims, 4 Drawing Sheets

(52) U.S. Cl.
CPC ..... *B05B 11/0037* (2013.01); *B05B 11/00442* (2018.08); *B05B 11/3047* (2013.01); *B05B 11/3087* (2013.01)

(58) Field of Classification Search
USPC ..... 222/190, 38.1, 501, 566, 567
See application file for complete search history.

(56) References Cited

U.S. PATENT DOCUMENTS 8,079,497 B2 * 12/2011 Brouwer ..... B05B 11/3087 222/135
8,616,414 B2 * 12/2013 Ciavarella ..... B05B 7/0037 222/1
2005/0006411 A1 * 1/2005 Kuwahara ..... B05B 11/3004 222/321.1
2010/0224652 A1 9/2010 Lim
2010/0264169 A1 * 10/2010 Crawford ..... A45D 34/02 222/192
2011/0284587 A1 * 11/2011 Galazka ..... B05B 7/0037 424/70.1
2011/0297700 A1 * 12/2011 Santagiuliana ..... B05B 11/3001 222/153.13
2013/0200098 A1 * 8/2013 Li ..... A47K 5/16 222/52
2014/0008394 A1 * 1/2014 Hofte ..... B05B 7/0037 222/190

FOREIGN PATENT DOCUMENTS

CN 102673902 A 9/2012
JP H05-077049 U 10/1993
JP 2002-326044 A 11/2002
JP 3609486 B2 1/2005
JP 2010-149904 A 7/2010
JP 5246573 B2 7/2013

OTHER PUBLICATIONS

Nov. 6, 2018 Office Action issued in Chinese Patent Application No. 201680030617.5.
Nov. 27, 2018 Office Action issued in Japanese Patent Application No. 2015-109501.

* cited by examiner

PUMP TYPE DISPENSER

TECHNICAL FIELD

The present invention relates to a pump type dispenser which dispenses a content liquid with which a container is filled toward the outside, and particularly relates to a pump type dispenser including a dispensing member capable of dispensing a content liquid in a predetermined form. Priority is claimed on Japanese Patent Application No. 2015-109501, filed May 29, 2015, the content of which is incorporated herein by reference.

BACKGROUND ART

In containers filled with content liquids such as shampoos, body soaps, hand soaps, or facial cleansers, a pump type dispenser held by a mouth portion of the container is frequently used. In such a pump type dispenser, the pump is driven by repeatedly pushing down a nozzle head which then be restored to dispense the content liquid.

In such a pump type dispenser, although it is common to directly dispense a content liquid from an opening at a distal end of the nozzle head, there are pump type dispensers in which a dispensing member (mouthpiece) is attached to the opening at the distal end of the nozzle head to dispense the content liquid in a predetermined form (for example, dispensing the content liquid divided into a plurality of portions, dispensing the content liquid from a longer distance than usual, or the like) (see Patent Document 1, for example).

CITATION LIST

Patent Document

[Patent Document 1]
Japanese Patent Publication No. 3609486

SUMMARY OF INVENTION

Technical Problem

However, in such a pump type dispenser, it is necessary for a pump type dispenser to have a function of holding a dispensing member and preventing it from being separated so that the dispensing member is not accidentally detached from a nozzle head. In a pump type dispenser disclosed in Patent Document 1, a protruding portion is provided on an outer peripheral surface of a dispensing member, a recessed portion is provided inside a passage of a nozzle head, and the protruding portion is fitted into the recessed portion so that the dispensing member is held and prevented from being separated by the nozzle head.

That is, the recessed portion provided in the passage of the nozzle head is undercut. Therefore, it is necessary to consider releasability when molding the nozzle head.

The present invention has been made to solve the above problems, and it is an object of the present invention to provide a pump type dispenser capable of holding a dispensing member and preventing it from being separated without using a recessed portion provided in a conventional nozzle head.

Solution to Problem

A first aspect of the present invention is a pump type dispenser which includes a pump held by a mouth portion of a container and configured to suction and pressure-feed a content liquid in the container, and a nozzle head having an internal passage through which the pressure-fed content liquid passes and driving the pump by being repeatedly pushed down and restored. In the present pump type dispenser, the internal passage includes a vertical passage communicating with the pump and a lateral passage connected to the vertical passage and that opens toward the outside, and includes a protrusion protruding toward an inner side in a joining portion between the vertical passage and the lateral passage, a dispensing member extending from the opening of the internal passage toward the joining portion and configured to dispense the content liquid introduced from an inlet on the joining portion side from an outlet on the opening side is disposed in the lateral passage, and the dispensing member includes a recessed portion which engages with the protrusion to prevent separation from the lateral passage.

In a second aspect of the present invention, in the pump type dispenser of the first aspect, the dispensing member is made of a resin having flexibility and is bent with respect to an initial state after molding when disposed in the lateral passage.

In a third aspect of the present invention, in the pump type dispenser of the first aspect or second aspect, the vertical passage includes a vertical rib protruding toward an inner side and extending along the vertical passage, and the dispensing member includes a notch portion which engages with the vertical rib.

In a fourth aspect of the present invention, in the pump type dispenser of the third aspect, a foam member which foams the content liquid is provided on a downstream side of the pump and the vertical rib comes into contact with an upper end of the foam member.

Advantageous Effects of the Invention

According to a pump type dispenser of the present invention, a protrusion is provided in a joining portion between a vertical passage and a lateral passage in a nozzle head, and a dispensing member disposed in the lateral passage extends from an opening of the nozzle head toward the joining portion and includes a recessed portion which engages with the protrusion. Thereby, the protrusion (protruding portion) engages with the recessed portion so that the dispensing member can be held and prevented from being separated. In addition, when forming the nozzle head, a mold portion for forming the vertical passage and a mold portion for forming the lateral passage abut against each other in the joining portion between the vertical passage and the lateral passage. However, since the protrusion can be provided on the abutment surface, the protrusion does not become undercut when the nozzle head is released from the mold portion and thus good mold releasability can be obtained.

In addition, according to the pump type dispenser of the present invention, the dispensing member is made of a resin having flexibility and is bent (that is, in a bent state) with respect to an initial state after molding when disposed in the lateral passage. Thereby, the dispensing member is disposed in the lateral passage in a state in which it receives an urging force from the lateral passage. That is, even when a force is generated in a direction that causes the dispensing member to be separated from the nozzle head, since a resistance force is generated between the dispensing member and the lateral passage, it is possible to more reliably prevent the dispensing member from being separated and the engagement between the protruding portion and the recessed portion can be reliably maintained.

In addition, according to the pump type dispenser of the present invention, the vertical passage includes a vertical rib protruding toward an inner side and extending along the vertical passage and the dispensing member includes a notch portion which engages with the vertical rib. Thereby, it is possible to prevent the dispensing member from deviating in a direction crossing the vertical rib with respect to the nozzle head.

In addition, according to the pump type dispenser of the present invention, a foam member is provided on a downstream side of the pump. Thereby, since the content liquid can be foamed, it is easy to maintain a form of the content liquid dispensed from the dispensing member. Also, the vertical rib is in contact with an upper end of the foam member. Thereby, it is possible for the vertical rib to have a function of preventing the foam member from being separated (a function of positioning).

Figure 1:
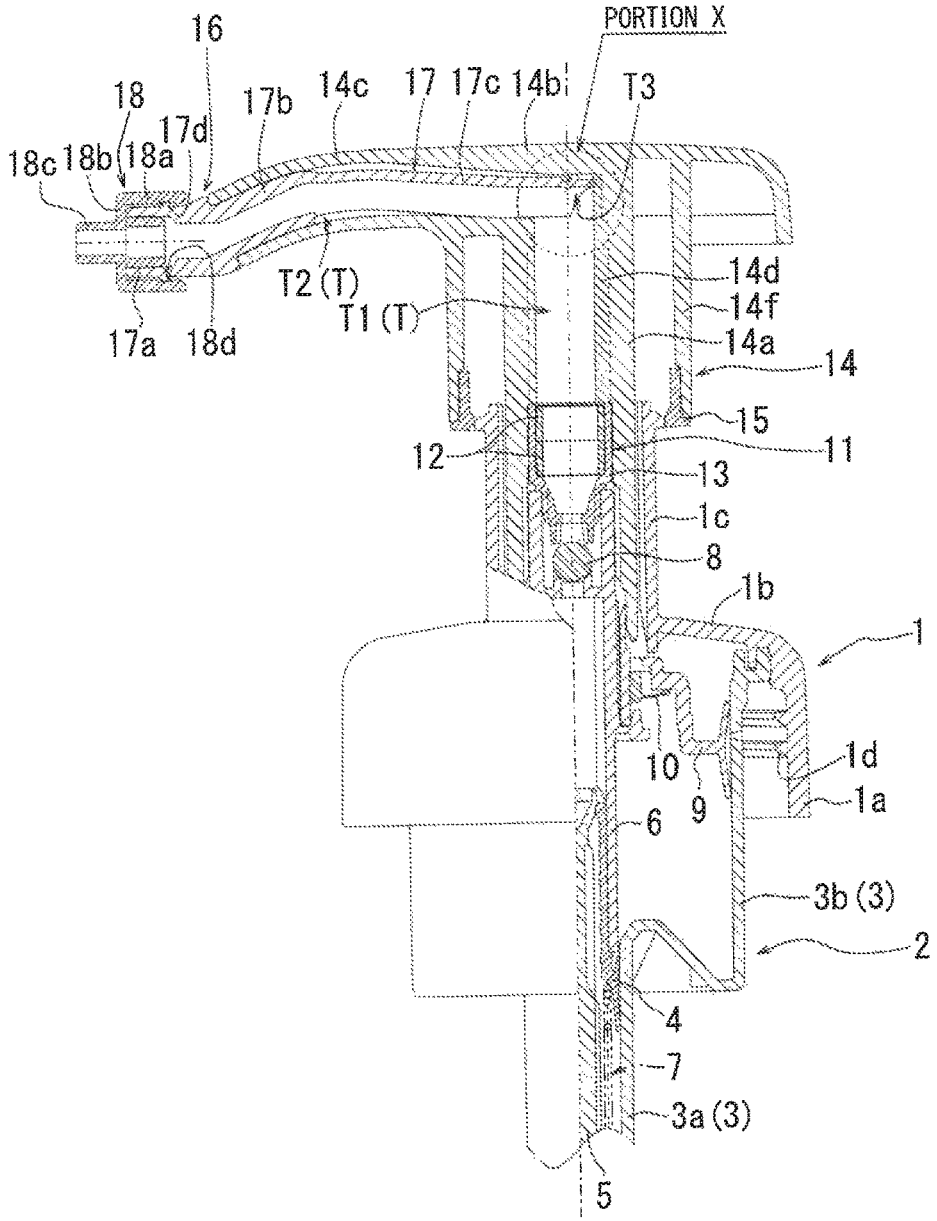
FIG. 1 is a cross-sectional view showing one embodiment of a pump type dispenser according to the present invention.
Figure 4:
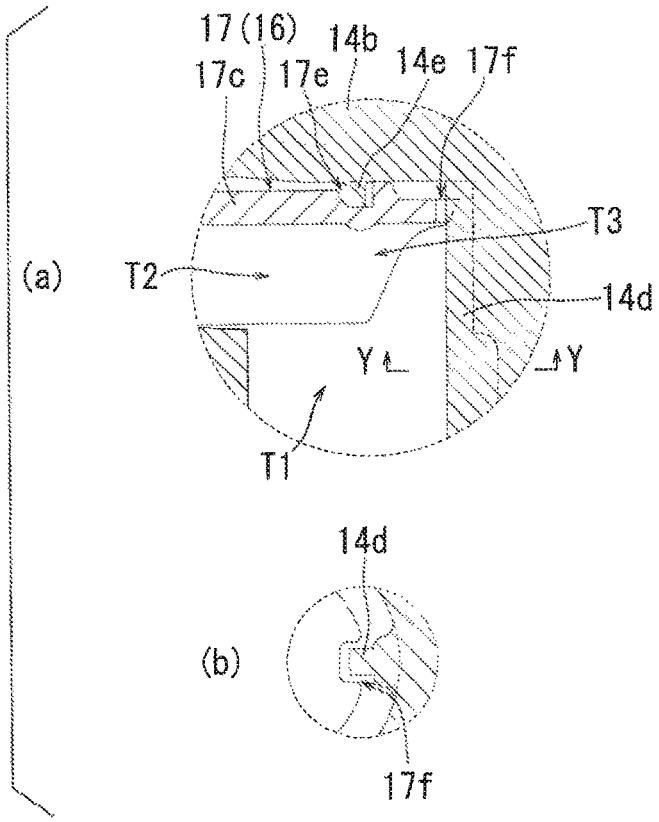

(a) of FIG. 4 is a partially enlarged cross-sectional view of a portion X in FIG. 1, and (b) of FIG. 4 is a cross-sectional view taken along line Y-Y shown in (a) of FIG. 4.

Figure 5:
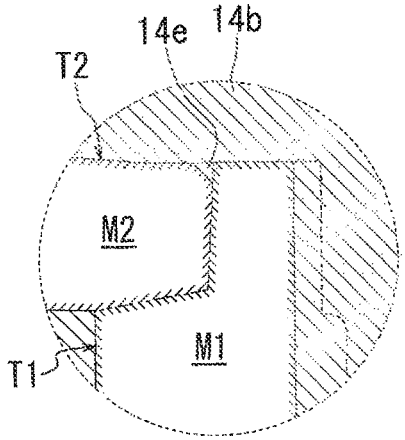

FIG. 5 is a partially enlarged cross-sectional view for describing a formation position of a protrusion formed in a joining portion.

DESCRIPTION OF EMBODIMENTS

Hereinafter, one embodiment of a pump type dispenser according to the present invention will be described in detail with reference to the drawings. In the specification, claims, and abstract of the present application, "upper" refers to a side on which a nozzle head is positioned with respect to a base cap to be described below, and "lower" refers to a side opposite thereto. In addition, "front" refers to a side on which an opening of the nozzle head is positioned with respect to a central axis of the nozzle head, and "rear" refers to the opposite side.

In FIG. 1, reference sign 1 shows a base cap mounted on a mouth portion of a container (not shown). The base cap 1 includes a cylindrical circumferential wall 1*a* which surrounds the mouth portion of the container, a donut-shaped top surface wall 1*b* which extends toward a radial inner side from an upper end of the circumferential wall 1*a*, and a cylindrical wall 1*c* which stands up from an inner circumferential edge of the top surface wall 1*b*. Also, on an inner circumferential surface of the circumferential wall 1*a*, a female screw portion 1*d* which engages with a male screw portion provided at the mouth portion of the container is provided. In order to hold the base cap 1 in the container, other conventionally known engaging member such as undercut may be used.

In FIG. 1, reference sign 2 shows a pump suspended and held by the mouth portion of the container by the base cap 1 and configured to pump up a content liquid with which the container is filled. The pump 2 includes a cylinder 3, a content liquid piston 4, a poppet 5, a stem 6, a spring 7, a ball valve 8, an air piston 9, and a check valve 10. The cylinder 3 includes a small-diameter cylindrical body 3*a* and a large-diameter cylindrical body 3*b* which are arranged in series. The content liquid piston 4, the poppet 5, the stem 6, the spring 7, the ball valve 8, the air piston 9, and the check valve 10 are incorporated in the cylinder 3. The pump 2 suctions, pressurizes, and pressure-feeds the content liquid and air individually when the stem 6 is pushed down and restored.

Reference sign 11 shows a foam member in which the content liquid and air pressure-fed from the pump 2 join to foam the content liquid. The foam member 11 of the present embodiment is provided at an upper portion of the stem 6. The foam member 11 is constituted by a mesh ring 12 in which a mesh is attached to one end portion of a ring-shaped main body portion and a jet ring 13 which holds the mesh ring 12 (holds two mesh rings 12 in the present embodiment).

Reference sign 14 shows a nozzle head. The nozzle head 14 includes an inner cylinder 14*a* surrounding the foam member 11 and connecting it to the stem 6, a top wall 14*b* serving as a pressing portion for pushing down the nozzle head when the stem 6 connected to the inner cylinder 14*a* is pushed down, and a nozzle 14*c* connected to the top wall 14*b* and extending in a lateral direction. Also, inside the nozzle head 14, an internal passage T including a vertical passage T1 formed inside the inner cylinder 14*a* and a lateral passage T2 formed inside the nozzle 14*c* are provided. In addition, one end of the lateral passage T2 is connected to the vertical passage T1 and the other end thereof opens toward the outside. In addition, in the rear of an inner surface of the inner cylinder 14*a*, a vertical rib 14*d* extending along the vertical passage T1 is provided. The vertical rib 14*d* is in contact with an upper end of the jet ring 13 to cover a portion of the mesh ring 12 and prevents the mesh ring 12 and the jet ring 13 from being separated.

As shown in FIGS. 4 and 5, a protrusion 14*e* protruding from the top wall 14*b* toward the inside (the internal passage T) is provided in a joining portion T3 in which the vertical passage T1 and lateral passage T2 are connected. As shown in FIG. 5, the protrusion 14*e* of the present embodiment is formed on an abutment surface between a mold portion M1 for forming the vertical passage T1 and a mold portion M2 for forming the lateral passage T2 at the time of molding the nozzle head 14. Specifically, since an upper end portion of a rear end of the mold portion M2 is inclined (curved in the present embodiment), a space is formed between an upper end surface of an abutment surface of the mold portion M1 and an upper end surface of an abutment surface of the mold portion M2 when the mold portion M1 and the mold portion M2 abut against each other. The protrusion 14*e* is formed due to the space generated at the time of molding the nozzle head 14. That is, since this space is merely surrounded by the upper end surface of the abutment surface of the mold portion M1 and the upper end surface of the abutment surface of the mold portion M2, the protrusion 14*e* after molding is not an obstacle when removing the nozzle head 14 after the molding from the mold portion M1 and the mold portion M2. Thus, since the protrusion 14*e* does not become undercut, good mold releasability can be obtained.

Also, as shown in FIG. 1, the nozzle head 14 includes an outer cylinder 14*f* which surrounds the inner cylinder 14*a*.

Further, an annular member 15 attached to a lower end of the outer cylinder 14*f* to reduce a gap with the cylindrical wall 1*c* of the base cap 1 is provided in the present embodiment.

A dispensing member 16 is disposed in the lateral passage T2. The dispensing member 16 of the present embodiment includes an insertion member 17 which extends from an opening of the nozzle 14*c* toward the joining portion T3 and a dispensing head 18 attached to a front of the insertion member 17.

Figure 3A:
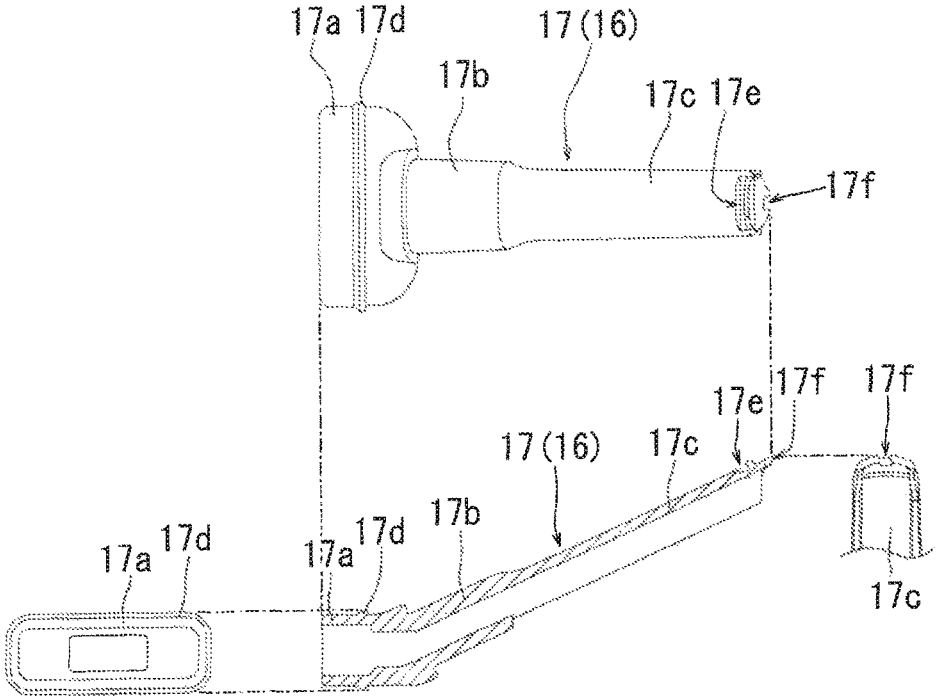
FIG. 3A shows a plan view, a cross-sectional view, a front view, and a rear view showing an initial state of an insertion member constituting the dispensing member.

As shown in FIG. 3A, the insertion member 17 includes a rectangular base portion 17*a*, an annular wall 17*b* extending obliquely upward from a rear end of the base portion 17*a* and having a rectangular shape smaller than the base portion 17*a*, and a tubular wall 17*c* extending in the same direction as an extension direction of the annular wall 17*b* from a rear end of the annular wall 17*b* and having a U-shaped cross section with its lower side open. In addition, a protruding portion 17*d* which protrudes toward an outer side is provided on an outer peripheral surface of the base portion 17*a*, and a groove-shaped recessed portion 17*e* is provided on an upper surface of a rear end side of the tubular wall 17*c*. In addition, the recessed portion 17*e* may be a through hole penetrating the tubular wall 17*c*. Further, a notch portion 17*f* is provided in a center portion of a rear end of the tubular wall 17*c*. FIG. 3A shows the insertion member 17 in an initial state after molding.

Figure 3B:
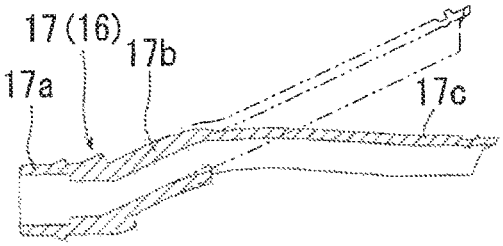
FIG. 3B is a cross-sectional view showing a state in which the insertion member is bent when disposed in a lateral passage.

The insertion member 17 is made of a resin having flexibility and is bent downward as shown by a solid line in FIG. 3B when disposed in the lateral passage T2 as compared with an initial state shown by a virtual line in FIG. 3B.

Figure 2:
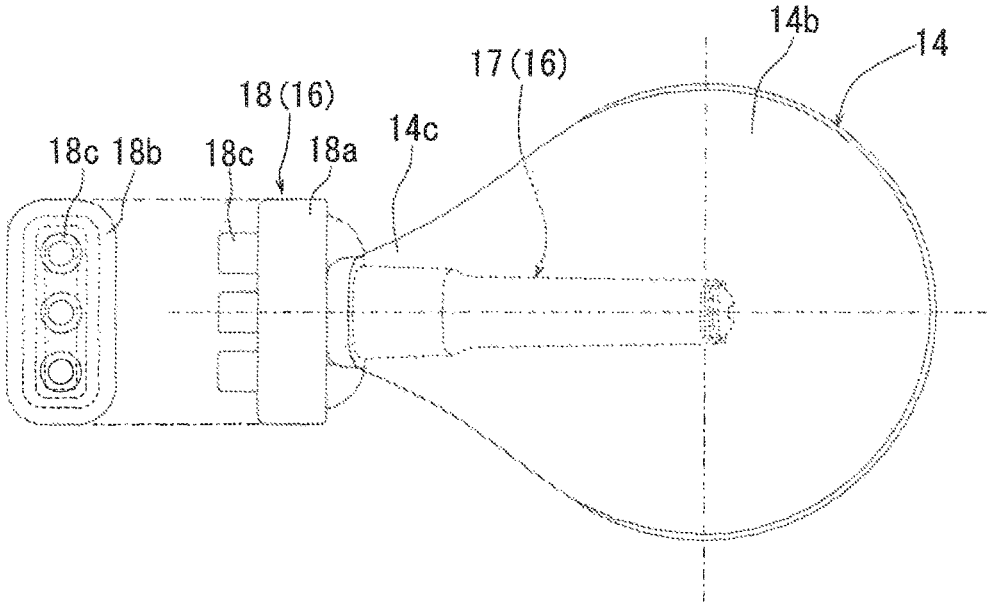
FIG. 2 is a plan view of the pump type dispenser shown in FIG. 1 and is a front view of a dispensing head constituting a dispensing member.

As shown in FIGS. 1 and 2, the dispensing head 18 includes a rectangular outer wall 18*a* surrounding the base portion 17*a* of the insertion member 17, a top wall 18*b* provided at a front end of the outer wall 18*a*, and a cylindrical dispensing tube 18*c* extending toward a front side from the top wall 18*b* (in the present embodiment, three dispensing tubes 18*c* in total are arranged in a line). In addition, a claw portion 18*d* engaging with the protruding portion 17*d* is provided on an inner peripheral surface of the outer wall 18*a*.

When the dispensing member 16 including the insertion member 17 and the dispensing head 18 as described above is disposed in the lateral passage T2, the recessed portion 17*e* engages with the protrusion 14*e* as shown in (a) of FIG. 4. Therefore, the dispensing member 16 is held and prevented from being separated from the nozzle head 14. At this time, the insertion member 17 is in the bent state (bent state) as compared with the initial state. Therefore, a portion of the insertion member 17 comes into contact with the nozzle head 14 while pressing against the nozzle head 14 due to a restoring force that restores the initial state from the bent state. In the present embodiment, since the tubular wall 17*c* has a U-shaped cross section (since there are walls not only on the top portion but also on both sides), an elastic force of the tubular wall 17*c* becomes stronger than when there is no wall on either side portion. Thereby, the insertion member 17 can be brought into contact with the nozzle head 14 while pressing against the nozzle head 14 with even greater restoring force. Therefore, even when a force is generated in a direction that causes the insertion member 17 to be separated from the nozzle head 14, since a resistance force is generated between the nozzle head 14 and the insertion member 17, it is possible to more reliably prevent the insertion member 17 from being separated. In addition, since the restoring force that restores the initial state from the bent state of the insertion member 17 acts in an upward direction, the engagement of the recessed portion 17*e* with respect to the protrusion 14*e* is made even stronger and more reliable and it is possible to more reliably prevent the insertion member 17 from being separated. The annular wall 17*b* of the insertion member 17 is in close contact with an inner surface of the nozzle 14*c* (a surface forming the lateral passage T2). Therefore, the content liquid does not leak out from a region in which the annular wall 17*b* of the insertion member 17 and the inner surface of the nozzle 14*c* are in contact with each other.

Although the preferred embodiments of the present invention have been described with reference to the drawings, the present invention is not limited to the above-described embodiments. The shapes and combinations of the constituent members or the like shown in the above-described embodiments are merely examples, and various modifications can be made based on design requirements or the like without departing from the scope of the present invention.

For example, in the above embodiment, the foam member is provided for the pump type dispenser, but the foam member may not be provided and the content liquid may be directly dispensed. Also, the number, arrangement, hole diameter, or the like of the dispensing tube provided in the dispensing head may be appropriately changed in accordance with a desired dispensing mode of the content liquid. In addition, the pump is not limited to the pump of the aspect described above, and conventionally known pumps of other aspects may be used.

INDUSTRIAL APPLICABILITY

According to the pump type dispenser of the present invention, a dispensing member can be held and prevented from being separated. Further, it is possible to obtain good mold releasability when forming a nozzle head.

REFERENCE SIGNS LIST

1 Base cap
1*a* Circumferential wall
1*b* Top surface wall
1*c* Cylindrical wall
1*d* Female screw portion
2 Pump
3 Cylinder
3*a* Small-diameter cylindrical body
3*b* Large-diameter cylindrical body
4 Content liquid piston
5 Poppet
6 Stem
7 Spring
8 Ball valve
9 Air piston
10 Check valve
11 Foam member
12 Mesh ring
13 Jet ring
14 Nozzle head
14*a* Inner cylinder
14*b* Top wall
14*c* Nozzle
14*d* Vertical rib
14*e* Protrusion
14*f* Outer cylinder
15 Annular member
16 Dispensing member
17 Insertion member
17*a* Base portion

17*b* Annular wall
17*c* Tubular wall
17*d* Protruding portion
17*e* Recessed portion
17*f* Notch portion
18 Dispensing head
18*a* Outer wall
18*b* Top wall
18*c* Dispensing tube
18*d* Claw portion
M1 Mold portion for forming vertical passage
M2 Mold portion for forming lateral passage
T Internal passage
T1 Vertical passage
T2 Lateral passage
T3 Joining portion

The invention claimed is:

1. A pump type dispenser comprising:

a pump held by a mouth portion of a container and configured to suction and pressure-feed a content liquid in the container; and a nozzle head having an internal passage through which the pressure-fed content liquid passes and driving the pump by being repeatedly pushed down and restored, wherein the internal passage includes a vertical passage communicating with the pump and a lateral passage connected to the vertical passage and provided with an opening that opens toward the outside, and the nozzle head includes a top wall serving as a pressing portion to push down the nozzle head and a protrusion protruding from the top wall toward the vertical passage in a joining portion in which the vertical passage and the lateral passage are connected, a dispensing member extending from the opening of the lateral passage toward the joining portion and configured to dispense the content liquid introduced from an inlet of the dispensing member close to the joining portion from an outlet of the dispensing member close to the opening is disposed in the lateral passage, and the dispensing member includes a recessed portion which engages with the protrusion to prevent separation from the lateral passage.

2. The pump type dispenser according to claim 1, wherein the dispensing member is made of a resin having flexibility and is bent with respect to an initial state after molding when disposed in the lateral passage.

3. The pump type dispenser according to claim 1, wherein the vertical passage includes a vertical rib protruding toward an inner side and extending along the vertical passage and the dispensing member includes a notch portion which engages with the vertical rib.

4. The pump type dispenser according to claim 2, wherein the vertical passage includes a vertical rib protruding toward an inner side and extending along the vertical passage and the dispensing member includes a notch portion which engages with the vertical rib.

5. The pump type dispenser according to claim 3, wherein a foam member which foams the content liquid is provided on a downstream side of the pump and the vertical rib comes into contact with an upper end of the foam member.

6. The pump type dispenser according to claim 4, wherein a foam member which foams the content liquid is provided on a downstream side of the pump and the vertical rib comes into contact with an upper end of the foam member.

* * * * *